US009126801B2

(12) United States Patent
Yokoyama

(10) Patent No.: US 9,126,801 B2
(45) Date of Patent: Sep. 8, 2015

(54) BOBBIN

(71) Applicant: JANOME SEWING MACHINE Co., Ltd., Tokyo (JP)

(72) Inventor: Ushio Yokoyama, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 0 days.

(21) Appl. No.: 14/271,289

(22) Filed: May 6, 2014

(65) Prior Publication Data

US 2014/0346264 A1 Nov. 27, 2014

(30) Foreign Application Priority Data

May 24, 2013 (JP) ..... 2013-109818

(51) Int. Cl.
*B65H 75/28* (2006.01)
*D05B 63/00* (2006.01)
*D05B 57/28* (2006.01)

(52) U.S. Cl.
CPC ..... *B65H 75/28* (2013.01); *D05B 57/28* (2013.01); *D05B 63/00* (2013.01)

(58) Field of Classification Search
CPC ..... D05B 57/00; D05B 57/02; D05B 57/04; D05B 57/14; D05B 57/16; D05B 57/18; D05B 57/20; D05B 57/24; D05B 57/26; D05B 57/28; D05B 63/00; B65H 75/00; B65H 75/02; B65H 75/08; B65H 75/14; B65H 75/26; B65H 75/28
USPC ..... 112/229
See application file for complete search history.

(56) References Cited

U.S. PATENT DOCUMENTS

| | | | | |
|---|---|---|---|---|
| 2,340,574 | A | 2/1944 | Ashworth | |
| 3,323,743 | A * | 6/1967 | Landgraf | 242/586.2 |
| 3,462,097 | A * | 8/1969 | Wilson | 242/118.4 |
| 4,462,324 | A * | 7/1984 | Larsen | 112/279 |
| 4,824,041 | A * | 4/1989 | Myers | 242/118.41 |
| 6,082,278 | A * | 7/2000 | Asao et al. | 112/231 |
| 6,585,181 | B2 * | 7/2003 | Kronenberger | 242/129.8 |
| 6,725,793 | B2 * | 4/2004 | Lee et al. | 112/279 |
| 2003/0029365 | A1 * | 2/2003 | Butzen et al. | 112/273 |
| 2010/0206207 | A1 * | 8/2010 | Fluckiger et al. | 112/231 |

FOREIGN PATENT DOCUMENTS

| | | | |
|---|---|---|---|
| JP | 3072607 | U | 10/2000 |
| JP | 2007-185432 | A | 7/2007 |
| JP | 2010-012016 | A | 1/2010 |
| WO | WO 00/37727 | A1 | 6/2000 |
| WO | WO 02/18694 | A2 | 3/2002 |
| WO | WO 02/18694 | A3 | 3/2002 |
| WO | WO 03/091492 | A1 | 11/2003 |
| WO | WO 2005/068704 | A1 | 7/2005 |

OTHER PUBLICATIONS

Extended European Search Report dated Aug. 6, 2014.

* cited by examiner

*Primary Examiner* — Ismael Izaguirre
(74) *Attorney, Agent, or Firm* — McGinn IP Law Group, PLLC

(57) ABSTRACT

A bobbin includes a bobbin main body including flanges at both ends of a bobbin winder spindle for winding the bobbin thread and an outer flange attached to one of the flanges (a second flange) of the bobbin main body. A gap in which a thread end of the bobbin thread is housed is provided between the outer flange and the flange of the bobbin main body.

5 Claims, 9 Drawing Sheets

Y3-Y3 ARROW VIEW
1
2
12
12a
14, 22
21a
31
c
n
nt
Y3

Y4–Y4 ARROW VIEW

BOBBIN

BACKGROUND OF THE INVENTION

1. Field of the Invention

The present invention relates to a bobbin including a bobbin thread end housing mechanism that is capable of storing a bobbin thread without crushing the shape of the bobbin thread and that is also capable of satisfactorily storing the bobbin thread while preventing the end of the bobbin thread wound around a bobbin winder spindle from coming loose and complicated handling.

2. Description of the Related Art

In general, a bobbin is used in sewing by a sewing machine for home use. In general, during sewing machine use, usually, to use a needle thread and a bobbin thread of the same color, a user of the sewing machine stores, for each of thread colors, a plurality of bobbins wound with frequently-used threads and replaces the thread together with the bobbin to match the thread color of the needle thread.

However, the thread wound around the bobbin easily comes loose because of vibration and rotation and gets entangled with other threads to make work complicated. Moreover, for example, the entangled thread is cut and discarded to be wasted. As techniques for preventing the thread from coming loose, there are techniques disclosed in Japanese Patent Application Laid-Open No. 2010-12016, Japanese Patent Application Laid-Open No. 2007-185432, Japanese Utility Model Registration No. 3072607, and the like.

First, in Japanese Patent Application Laid-Open No. 2010-12016, a bobbin main body includes a thread stopper ring, which is a spring-like elastic member adjusted to the width of a thread winding section of a bobbin. A thread wound around the bobbin is retained by the thread stopper ring to prevent the thread from coming loose. In Japanese Patent Application Laid-Open No. 2007-185432, a V-shaped cutout is provided on one side of a flange of a bobbin. The end of an excess thread is inserted into and locked in the cutout.

In Japanese Utility Model Registration No. 3072607, a commercially available thread spool is used rather than a bobbin for winding a bobbin thread. The thread spool has structure in which, in a flange on one side or on both sides, a lid member having the same diameter as the flange is fit by a convex section and a groove having a concentric shape to hold and retain a thread end between the flange and the lid member.

In Japanese Patent Application Laid-Open No. 2010-12016, the thread stopper ring is a member separate from the bobbin main body. The thread stopper ring has to be detached from the bobbin main body during sewing work. Therefore, workability is extremely low. Moreover, it is likely that the thread stopper ring is lost during the sewing work. In Japanese Patent Application Laid-Open No. 2007-185432, the V-shaped cutout is formed in the flange of the bobbin.

Therefore, in a horizontal shuttle sewing machine, if the cutout faces a needle thread passing side, the cutout comes into contact with the needle thread to cause a stitch performance failure and a thread cut. Therefore, the flange having the cutout has to be set on the opposite side of the needle thread passing side. However, if a winding direction of a thread is incorrect when the thread is attached to an inner shuttle, this also causes a stitch performance failure and a thread cut.

In such a method for retaining a thread in the past, a thread is retained while being held and crushed. It is not preferable for the thread to be retained in a state in which stress is applied to the thread.

In Japanese Utility Model Registration No. 3072607, since the commercially available thread spool is used, the thread spool cannot be directly applied to the configuration of a bobbin case. Therefore, the thread spool cannot be attached to the inner shuttle.

SUMMARY OF THE INVENTION

It is an object (a technical task to achieve) of the present invention to provide a bobbin in which a housing section is provided that makes it easy to house the end of a bobbin thread wound around a bobbin winder spindle without crushing the shape of the bobbin thread, the bobbin being capable of being used in the same manner as a normal bobbin when attached to a sewing machine.

Therefore, to achieve the object, as a result of the earnest researches, the inventor provides, as a first aspect of the present invention, a bobbin in which a needle attached to a needle bar, which moves up and down, and a horizontal shuttle supply in cooperation with each other a bobbin thread for forming a stitch, this bobbin including: a bobbin main body including flanges at both ends of a bobbin winder spindle for winding the bobbin thread; and an outer flange attached to one of the flanges of the bobbin main body. A gap in which a thread end of the bobbin thread is housed is provided between the outer flange and the flange of the bobbin main body.

In a second aspect of the present invention, in the bobbin in the first aspect, a thread come-off preventing unit that prevents the housed thread end of the bobbin thread from coming off the gap may be provided in the gap. In a third aspect of the present invention, in the bobbin in the second aspect, the thread come-off preventing unit may be formed as a protrusion unit that projects from at least one of the outer flange and the flange of the bobbin main body to face the other one of the outer flange and the flange of the bobbin main body. Protrusion sections may project from both sides of the flange and the outer flange respectively to be opposed to each other.

In a fourth aspect of the present invention, in the bobbin in the third aspect, the protrusion section may be formed in the outer flange. In a fifth aspect of the present invention, in the bobbin in the third aspect, the protrusion section may be formed in the flange of the bobbin main body.

In a sixth aspect of the present invention, in the bobbin in the third aspect, protrusion sections may be formed in the flange of the bobbin main body and the outer flange respectively. In a seventh aspect of the present invention, in the bobbin in the first aspect, the gap may be set to be equal to or smaller than a thread diameter of the bobbin thread.

In the present invention, the gap in which the thread end of the thread is housed is provided between the outer flange and the flange of the bobbin main body. Therefore, by inserting the thread end into the gap, it is possible to house and retain the bobbin thread without crushing the shape of the bobbin thread. If the thread is crushed and retained as in the past, the shape of the bobbin thread is deformed to complicate the handling of the bobbin thread. However, in the present invention, since the shape of the bobbin thread is not deformed, it is easy to handle the bobbin thread.

Further, in the present invention the thread end is inserted into the gap to retain the thread end rather than forming a cutout in a flange section and locking a thread end in the cutout in a thread end come-off preventing structure of a thread spool in the past. When the thread spool in the past is attached to a sewing machine or the like, the thread end is carelessly caught by the cutout and cut. This is a hindrance to sewing machine work.

In the present invention, the thread end is inserted into and retained in the gap between the outer flange and the second flange. The bobbin thread is not caught by the gap. Consequently, it is possible to eliminate a deficiency that the bobbin thread is carelessly cut. It is possible to eliminate various problems such as wasteful use of a thread.

DESCRIPTION OF THE PREFERRED EMBODIMENTS

Figure 1A:
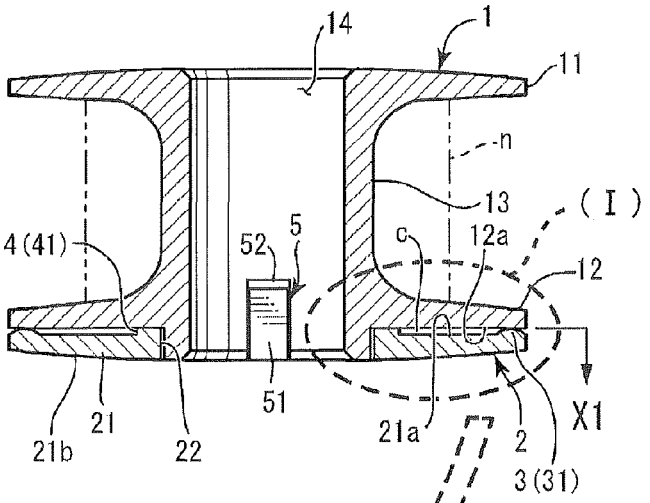
FIG. 1A is a longitudinal sectional side view of a first embodiment of the present invention.

Embodiments of the present invention are explained below with reference to the drawings. A bobbin in the present invention includes, as shown in FIGS. 1 to 3 and the like, a bobbin main body 1, an outer flange 2, a thread come-off preventing unit 3, a gap c, a gap forming unit 4, and a joining section 5. The bobbin main body 1 includes a flange and a bobbin winder spindle 13. A pair of the flanges is present. One of the flanges is referred to as first flange 11 and the other is referred to as second flange 12.

The bobbin winder spindle 13 is formed in a cylindrical shape. The first flange 11 is formed at one side end in the axial direction of the bobbin winder spindle 13. The second flange 12 is formed at the other side end. (see FIGS. 1A, 2A, 2B, and 3A).

The up-down direction of the bobbin in the present invention is determined in a state in which the bobbin is set in a horizontal shuttle of a sewing machine. When the axial direction of the bobbin winder spindle 13 of the bobbin main body 1 is set as a perpendicular direction, the first flange 11 is on the upper side and the second flange 12 is on the lower side (see FIG. 1A). That is, the second flange 12 of the bobbin is set in the bottom of an inner shuttle of the horizontal shuttle.

The first flange 11 and the second flange 12 are formed in a disk shape. One first flange 11 is used as a normal flange. A hole for thread winding 11*a* and the like is formed in the first flange 11. The outer flange 2 explained below is attached to the other second flange 12. The second flange 12 forms the gap c in conjunction with the outer flange 2.

A surface on the outer side of the second flange 12 (a surface on the opposite side of a surface continuing to the bobbin winder spindle 13) is referred to as housing side surface 12*a*. The outer flange 2 is attached to the housing side surface 12*a*. The housing side surface 12*a* forms the gap c, in which a thread end nt of a bobbin thread n is housed, in conjunction with the outer flange 2 (see FIGS. 1A, 1B, and 1D).

Figure 2A:
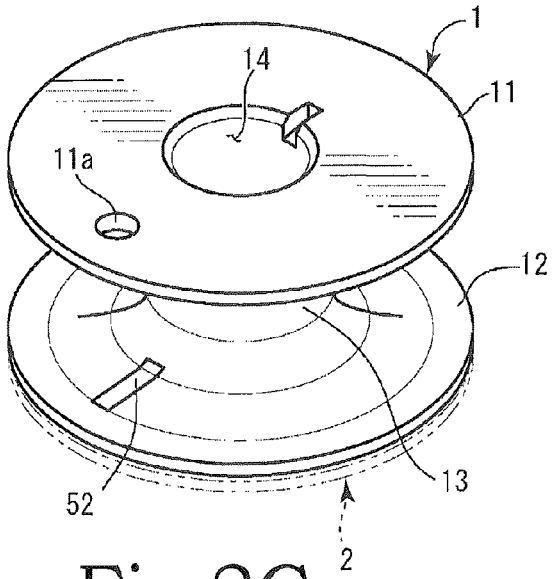
FIG. 2A is a perspective view of a bobbin main body in the first embodiment of the present invention.
Figure 2B:
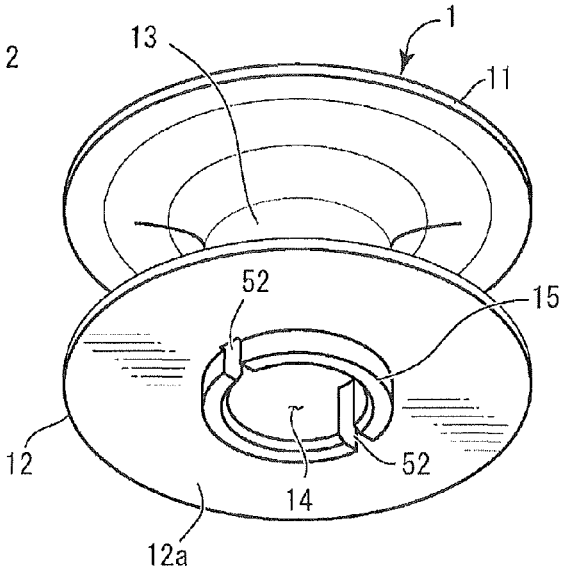
FIG. 2B is a perspective view of the bobbin main body viewed from a lower surface side.
Figure 2C:
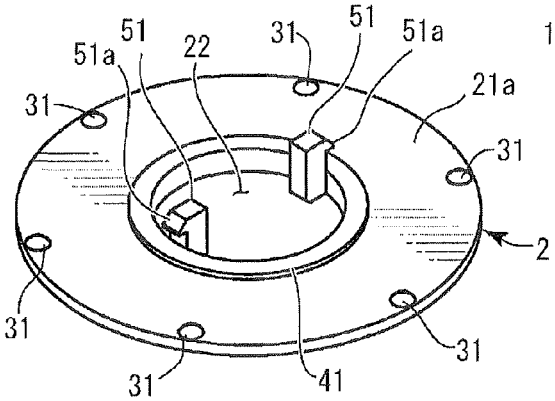
FIG. 2C is a perspective view of an outer flange including a gap forming unit of a first type.
Figure 2D:
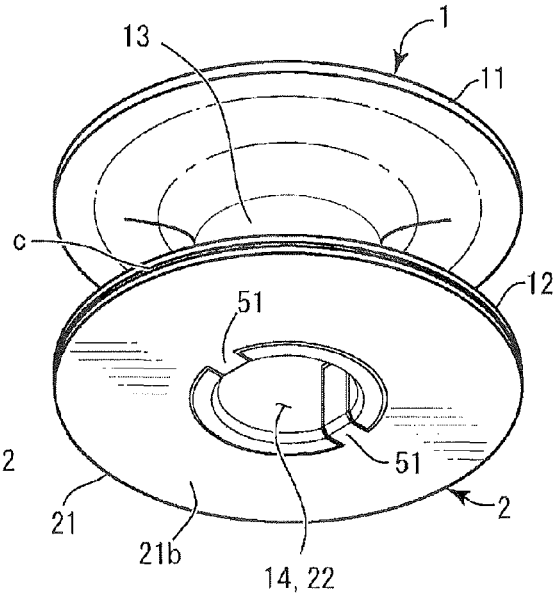
FIG. 2D is a perspective view of a state in which the bobbin main body and the outer flange are joined viewed from the lower surface side.
Figure 3A:
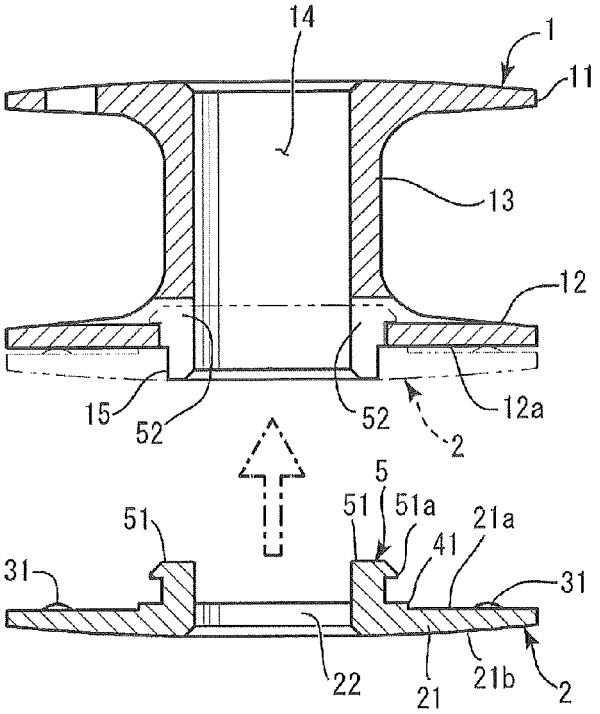
FIG. 3A is a longitudinal sectional side view of a state in which the bobbin main body and the outer flange are separated from each other in the first embodiment of the present invention.
Figure 3B:
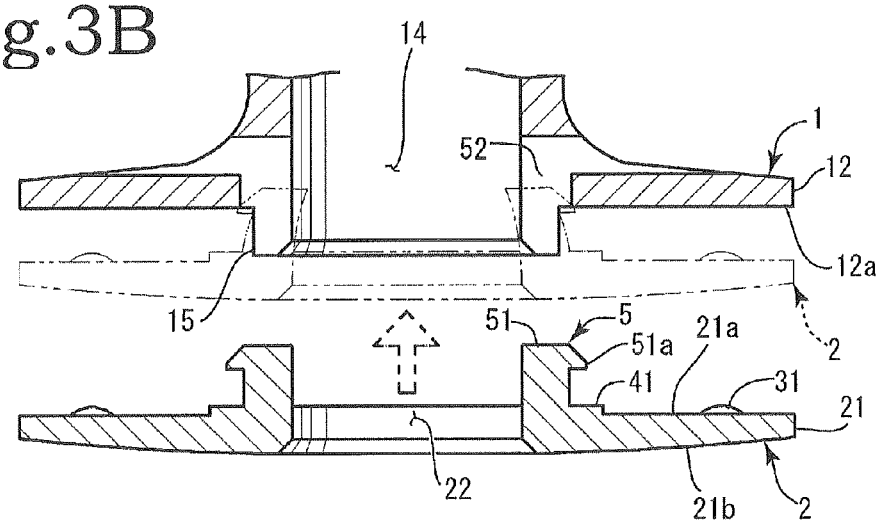
FIG. 3B is an enlarged longitudinal sectional side view of a main part in a state in which the bobbin main body and the outer flange are separated from each other.
Figure 3C:
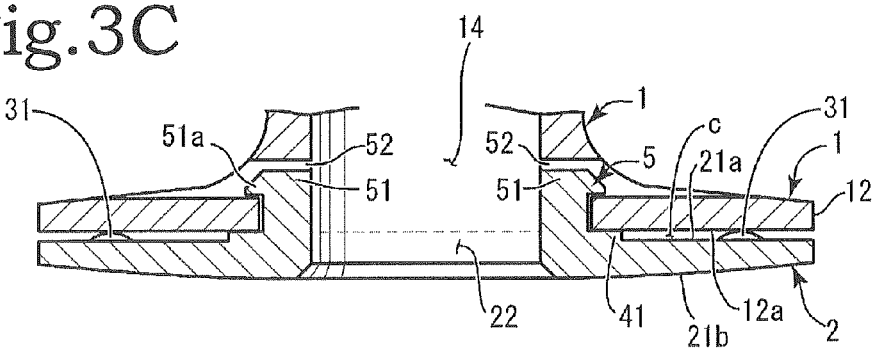
FIG. 3C is an enlarged longitudinal sectional side view of the main part in a state in which the outer flange is attached to the bobbin main body.

The second flange 12 and the outer flange 2 are joined, whereby a flange having a shape substantially equivalent to the shape of the first flange 11 is configured (see FIGS. 1A and 2D). A through-hole 14 piercing through the first flange 11, the second flange 12, and the bobbin winder spindle 13 in the axial direction is formed in the bobbin main body 1.

The second flange 12 is joined to the outer flange 2 via the joining section 5 explained below. Portions configuring the joining section 5 are provided in the second flange 12 and the outer flange 2. The bobbin main body 1 is formed of synthetic resin such as plastics.

In the outer flange 2, one surface of a disk section 21 formed in a disk shape is a housing side surface 21*a*. The outer flange 2 is formed of synthetic resin such as plastics (see FIG. 2C). In particular, a finely deformable soft material is suitable for the outer flange 2.

The housing side surface 21*a* of the outer flange 2 is a surface opposed to the housing side surface 12*a* of the second flange 12 in a state in which the outer flange 2 is attached to the second flange 12 of the bobbin main body 1. The housing side surface 21*a* is formed as a flat surface like the housing side surface 12*a*.

A surface on the outer side of the outer flange 2, which is a surface on the opposite side of the housing side surface 21*a* of the outer flange 2, is referred to as outer side surface 21*b*. The outer side surface 21*b* is formed in a flat spherical shape. A through-hole 22 is formed in the center position of the diameter of the outer flange 2. The axis of the through-hole 22 coincides with the axis of the through-hole 14 of the bobbin main body 1 in a state in which the outer flange 2 is attached to the bobbin main body 1.

The outer flange 2 is attached to the second flange 12 of the bobbin main body 1 with the gap c provided between the outer flange 2 and the second flange 12. The gap c means a space formed when the housing side surface 12*a* of the second flange 12 and the housing side surface 21*a* of the outer flange 2 are joined to be opposed to each other (see FIG. 3). When a space dimension between the housing side surfaces 12*a* and 21*a* is represented as δ, the space dimension δ is set to be the same in all portions of the housing side surfaces 12*a* and 21*a*.

The gap c formed by the second flange 12 of the bobbin main body 1 and the outer flange 2 plays a role for housing the thread end nt of the bobbin thread n wound around the bobbin winder spindle 13 and preventing the bobbin thread n coming loose from (coming off) the bobbin (see FIGS. 4E, 4F, 7, 8, and the like).

The thread come-off preventing unit 3 is provided in the gap c. The thread come-off preventing unit 3 plays a role for preventing a situation in which the thread end nt of the bobbin thread n housed in the gap c comes off the gap c and projects to the outside of the second flange 12 and the outer flange 2 and the bobbin thread n is easily released from the bobbin main body 1 of the bobbin.

The thread come-off preventing unit 3 may be formed according to a plurality of embodiments. First, in a first embodiment, a protrusion section 31 is formed that projects from at least one of the outer flange 2 and the flange of the bobbin main body 1 toward the other to be opposed to the other flange (see FIGS. 1, 2C, and 2E).

The protrusion section 31 is formed in at least one of the outer flange 2 and the second flange 12. Specifically, the protrusion section 31 is formed to project the outer circumferential side and the other side of the outer flange 2 and the first flange 11. There are three types of first embodiment.

As a first type, the protrusion section 31 is formed in the flange 2 (see FIGS. 1, 2C, 2E, 3, and the like). The protrusion section 31 is a swelling protrusion having a substantially semispherical shape and is an extremely small protrusion. A plurality of the protrusion sections 31 are formed at an equal interval in positions close to the outer circumferential end edge of the housing side surface 21*a* of the outer flange 2 and along the circumferential direction (see FIGS. 1C, 2C, and 2E). Specifically, a sextet of the protrusion sections 31 are formed (see FIG. 1C).

Figure 1B:
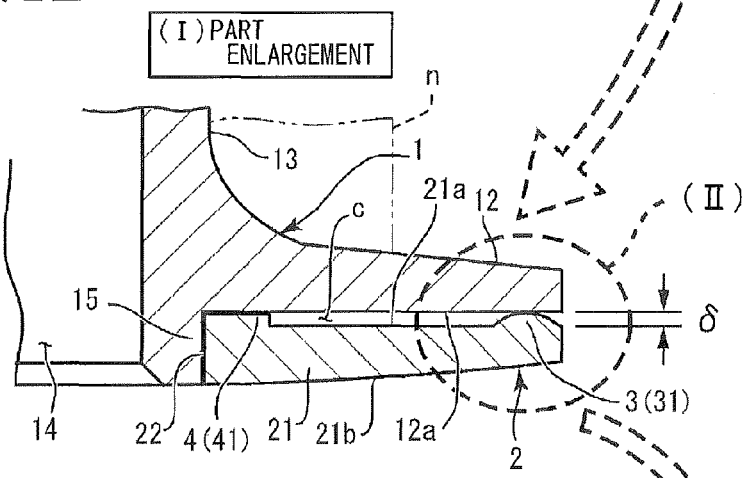
FIG. 1B is an enlarged view of a (I) part of FIG. 1A.
Figure 1C:
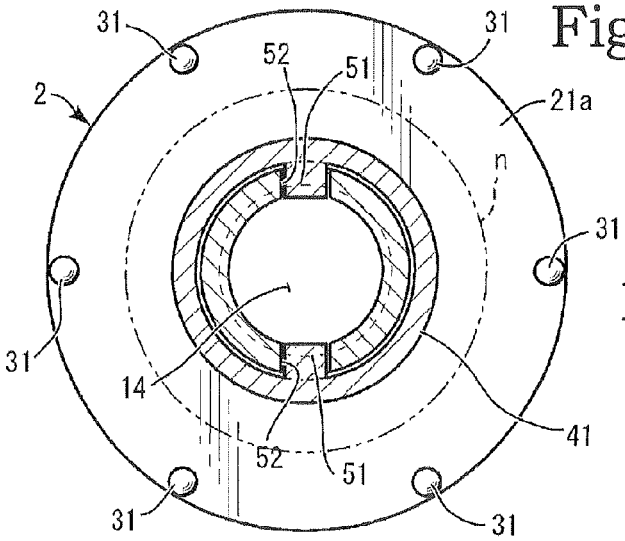
FIG. 1C is an X1-X1 arrow sectional view of FIG. 1A.
Figure 1D:
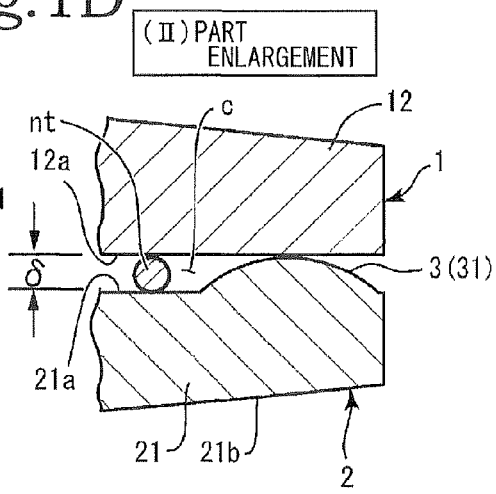
FIG. 1D is an enlarged view of a (II) part of FIG. 1B.

The height dimension from the housing side surface 21*a* of the outer flange 2 to the top of the protrusion section 31 is the same as or substantially the same as the space dimension δ of the gap c (see FIG. 1D). That is, the distal end of the protrusion section 31 is in contact with or near the housing side surface 12*a* of the second flange 12 opposed to the outer flange 2.

When the protrusion section 31 is near the housing side surface 12*a*, the space between the distal end of the protrusion section 31 and the housing side surface 12*a* is set smaller than a thread diameter d of the bobbin thread n. This is for the purpose of preventing the thread end nt of the bobbin thread n from easily coming off the gap c unless a force is applied to the thread end nt.

Figure 4A:
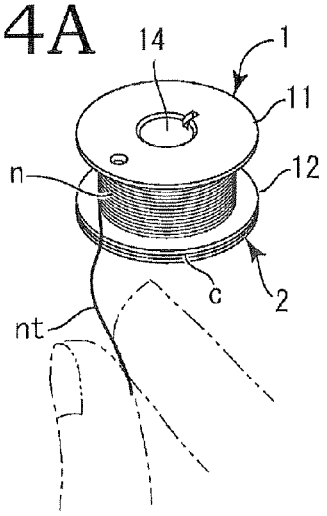
FIG. 4A is a perspective view of a state in which the end of a bobbin thread is drawn out from a bobbin in the present invention.
Figure 4B:
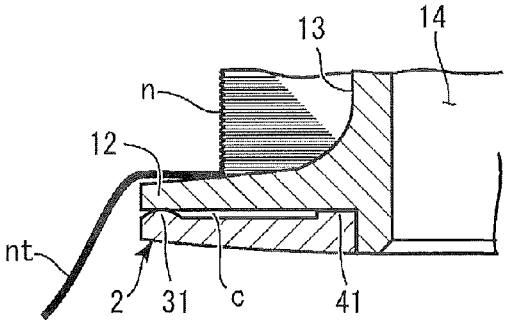
FIG. 4B is a main part enlarged longitudinal sectional side view of FIG. 4A.
Figure 4C:
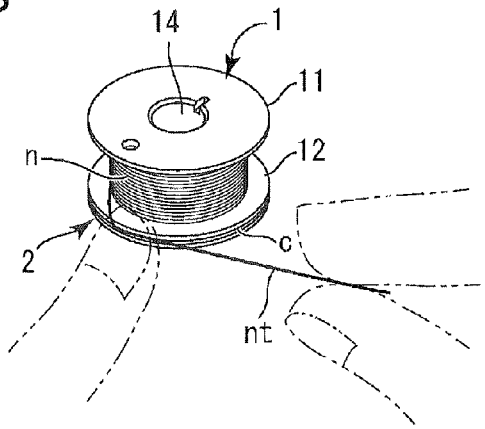
FIG. 4C is a perspective view of a state in which the end of the bobbin thread drawn out from the bobbin is started to be inserted into a gap.
Figure 4D:
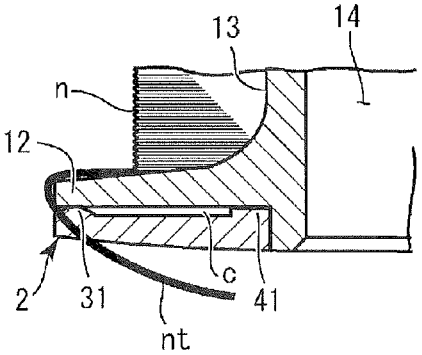
FIG. 4D is a main part enlarged longitudinal sectional side view of FIG. 4C.
Figure 4E:
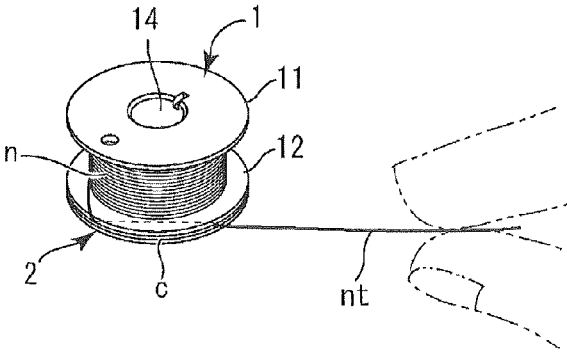
FIG. 4E is a perspective view of a state in which the bobbin thread drawn out from the bobbin climbs over a protrusion section and the bobbin thread is started to be housed on an inner side of the gap.
Figure 4F:
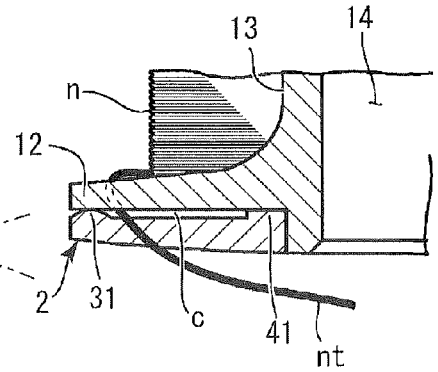
FIG. 4F is a main part enlarged longitudinal sectional side view of FIG. 4E.
Figures 5A, 5B:
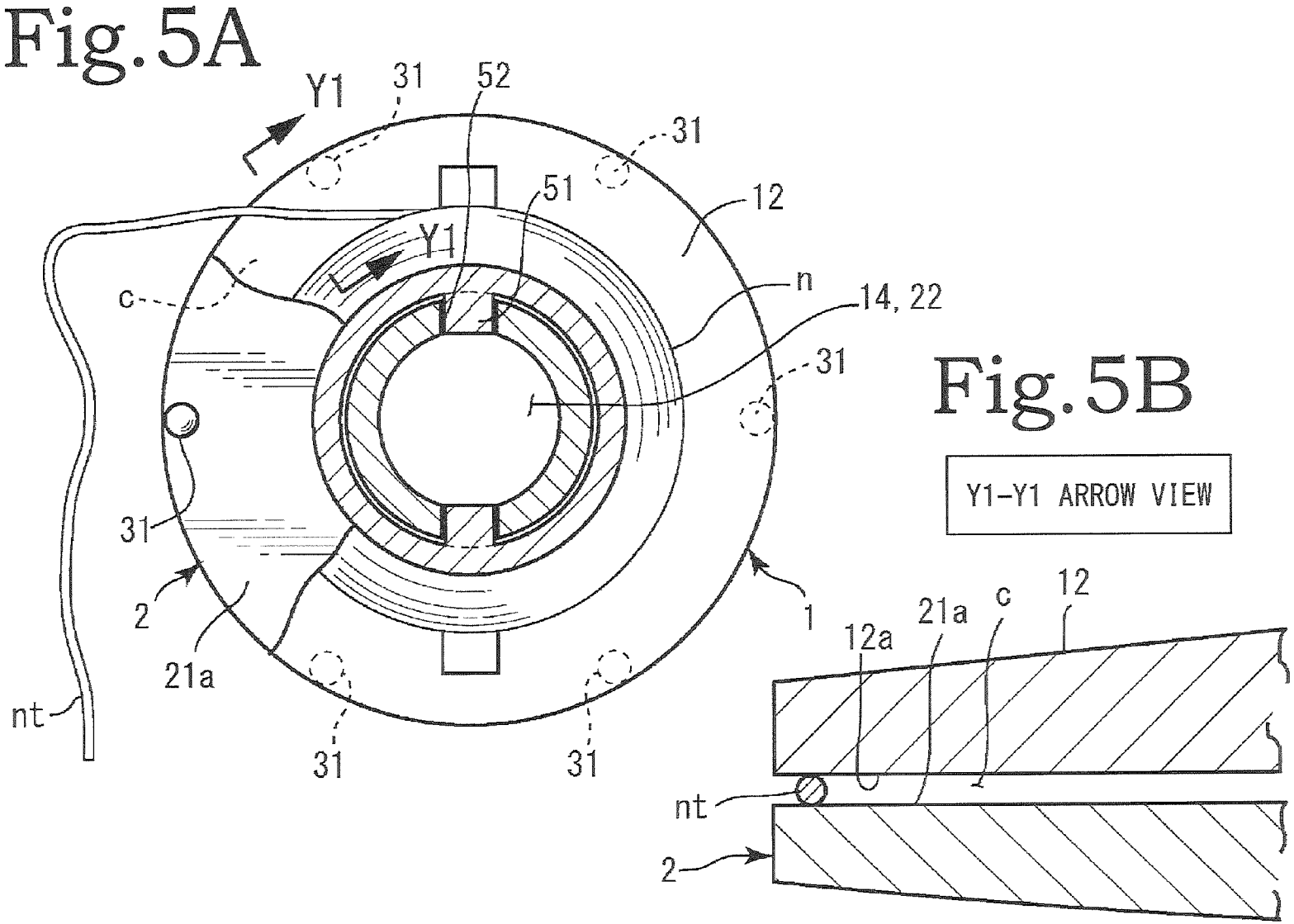
FIG. 5A is a partially-cut cross sectional plan view of a flange in a state in which the end of the bobbin thread is drawn out from the bobbin in the present invention.
FIG. 5B is a Y1-Y1 arrow enlarged sectional view of FIG. 5A.
Figures 6A, 6B:
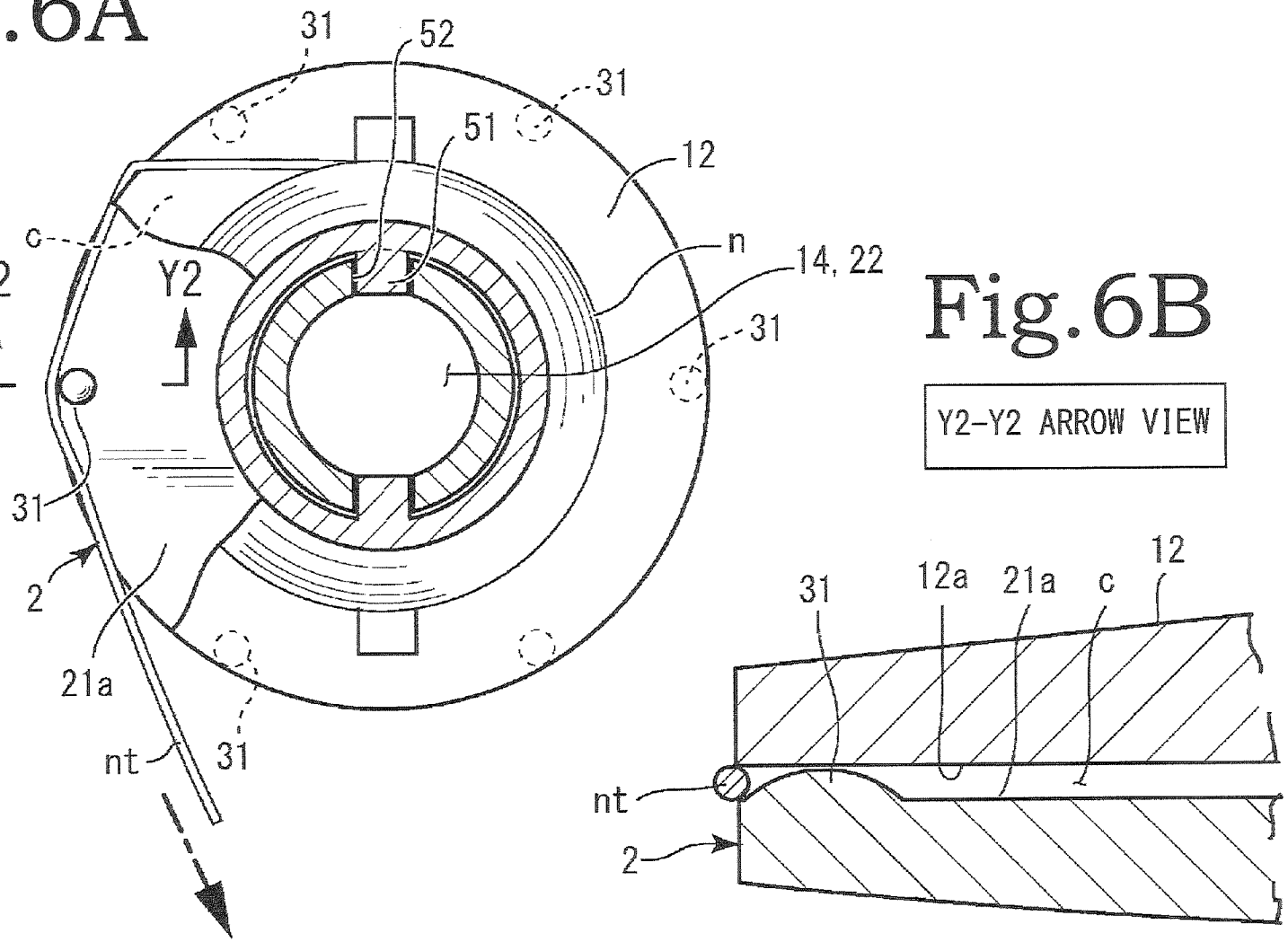
FIG. 6A is a partially-cut cross sectional plan view of a state in which the bobbin thread is located on outward side of the protrusion section while being inserted into the gap.
FIG. 6B is a Y2-Y2 arrow enlarged sectional view of FIG. 6A.
Figures 7A, 7B:
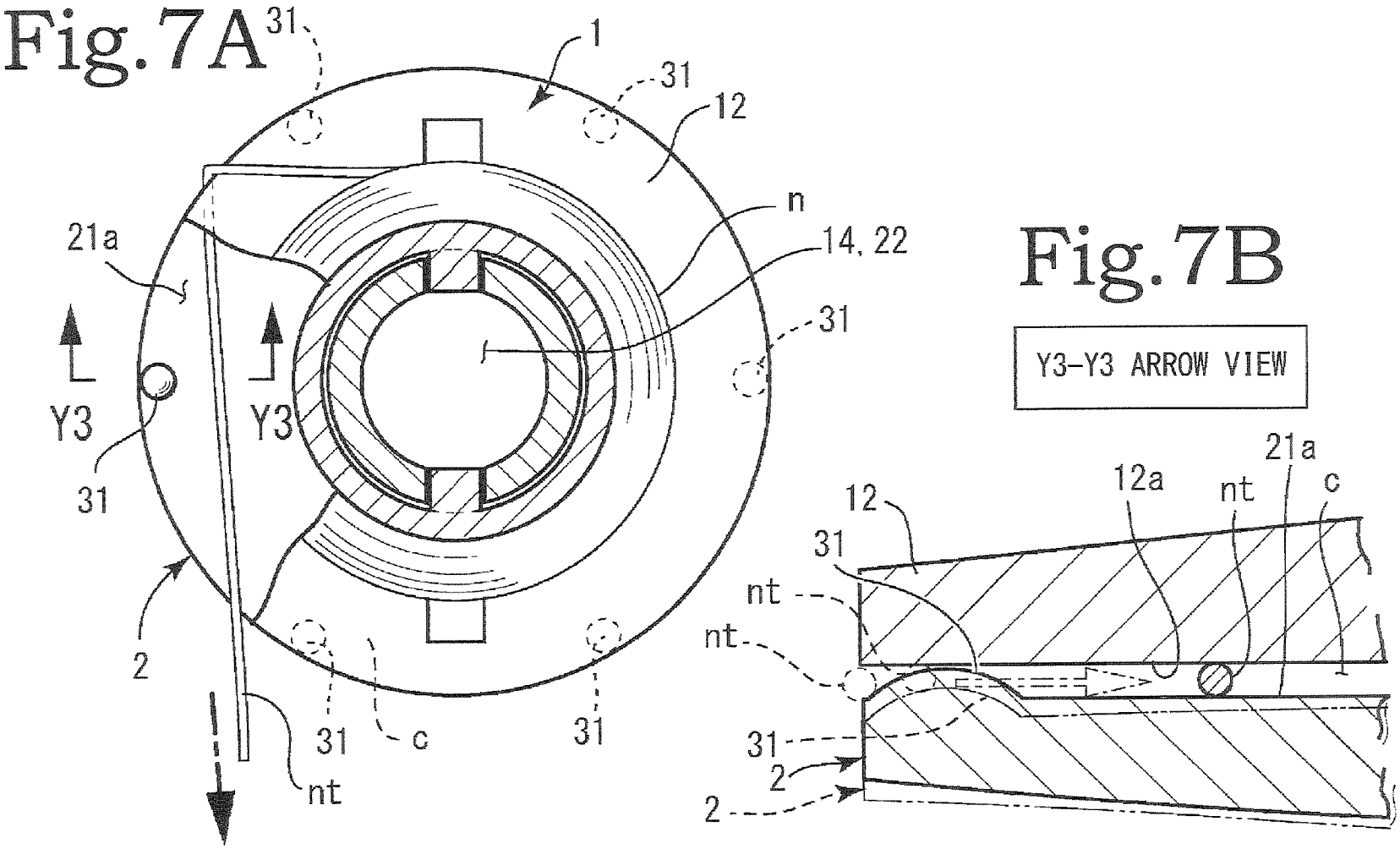
FIG. 7A is a partially-cut cross sectional plan view of a state in which the bobbin thread is located on the inner side of the gap to climb over the protrusion section while being inserted into the gap.
FIG. 7B is a Y3-Y3 arrow enlarged sectional view of FIG. 7A.
Figure 8A:
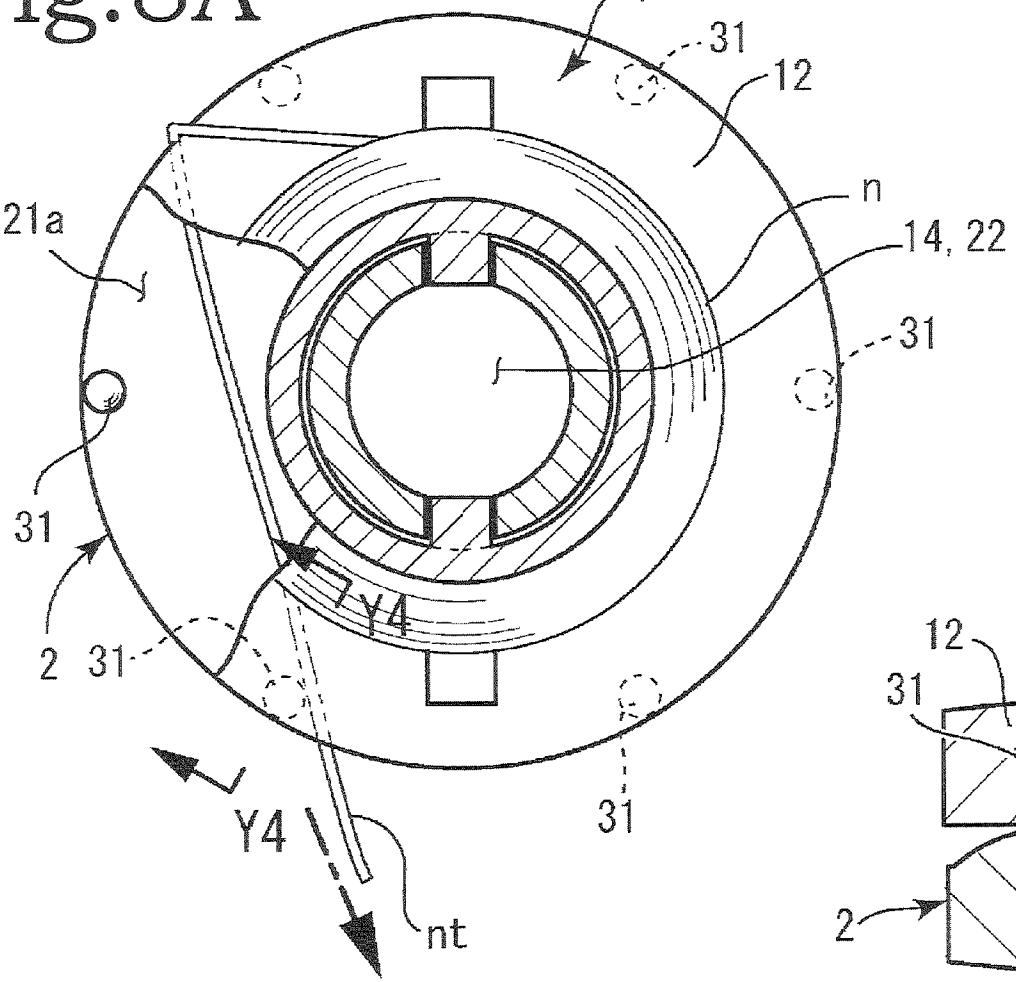
FIG. 8A is a partially-cut cross sectional plan view of a state in which the bobbin thread climbs over two protrusion sections and housing of the bobbin thread in the gap is completed.
Figure 8B:
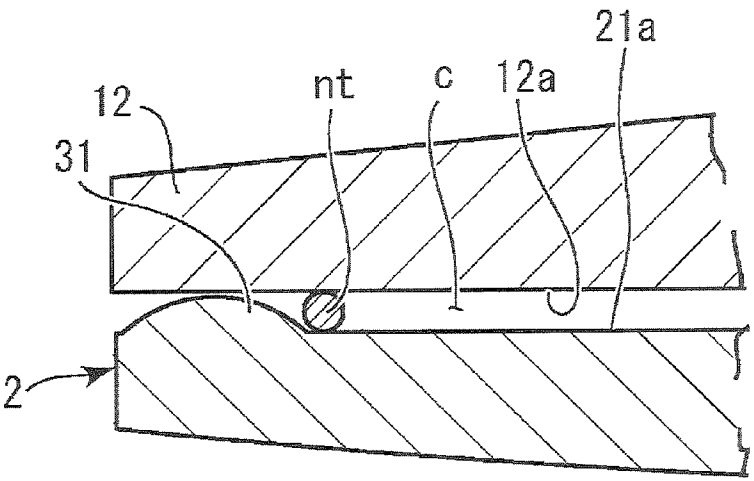
FIG. 8B is a Y4-Y4 arrow enlarged sectional view of FIG. 8A.

For fixing of the bobbin thread n in the first embodiment by the thread come-off preventing unit 3 formed as the protrusion section 31, first, the thread end nt of the bobbin thread n wound around the bobbin winder spindle 13 is drawn out from the bobbin and inserted into the gap c formed between the second flange 12 and the outer flange 2 (see FIGS. 4C and 4D).

In this case, the thread end nt of the bobbin thread n is moved toward the inner side of the gap c while a tensile force is applied to the thread end nt. Consequently, the thread end nt can climb over the protrusion section 31 formed in the gap c and enter the inner side of the gap c (see FIGS. 4E, 4F, and 7).

To enable the thread end nt of the bobbin thread n to easily climb over the protrusion section 31, it is preferable that the protrusion section 31 is formed in a flat spherical shape (see FIG. 1D) and the outer flange 2 is formed of soft synthetic resin. Consequently, the outer flange 2 can be slightly flexurally deformed. The thread end nt can easily climb over the protrusion section 31.

Figure 9A:
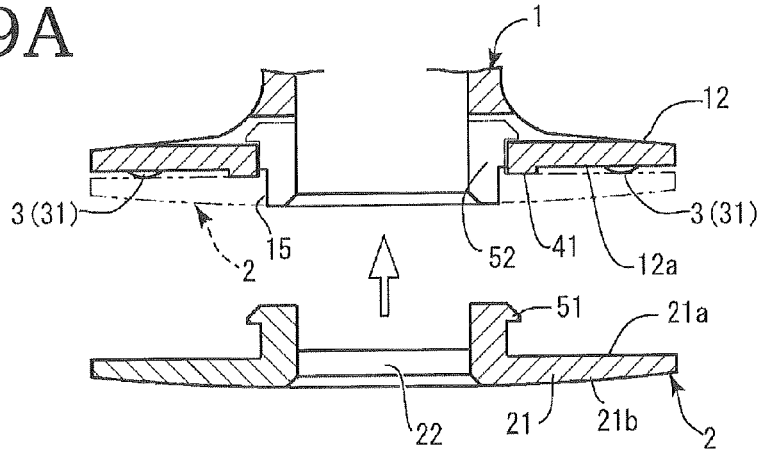
FIG. 9A is a main part longitudinal sectional side view of a state in which the protrusion section is provided in a flange of the bobbin main body and a second flange and the outer flange are separated in the first embodiment of the present invention.
Figure 9B:
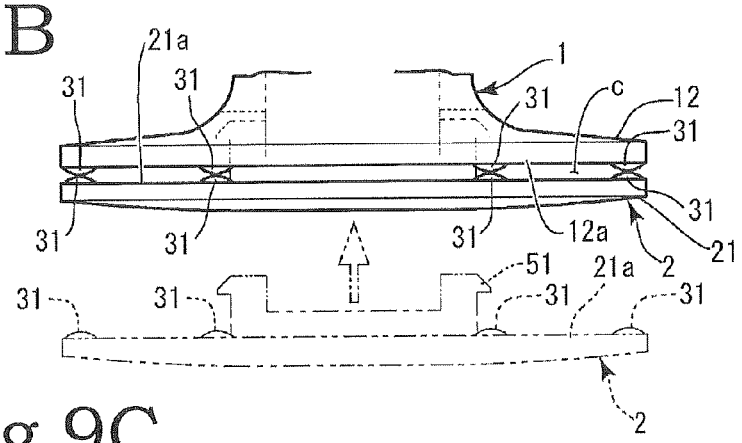
FIG. 9B is a main part longitudinal sectional side view of a state in which the protrusion sections are provided in both of the outer flange and the flange of the bobbin main body and the second flange and the outer flange are separated in the first embodiment of the present invention.

As a second type of the first embodiment, the protrusion section 31 is formed on the housing side surface 12*a* of the second flange 12 (see FIG. 9A). The shape of the protrusion section 31 in the second type is the same as the shape in the first type. Configuration of components formed on the housing side surface 12*a* of the second flange 12 is also the same as that in the first type.

Figure 9C:
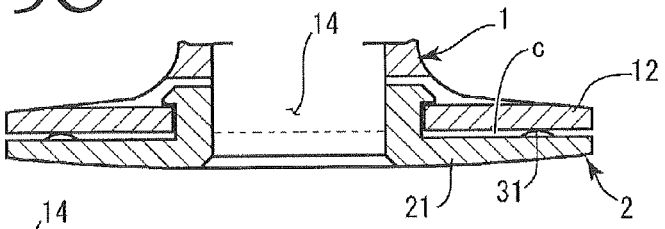
FIG. 9C is a main part longitudinal sectional side view in which the protrusion section is used as a gap forming unit in the first embodiment of the present invention.
Figure 9D:
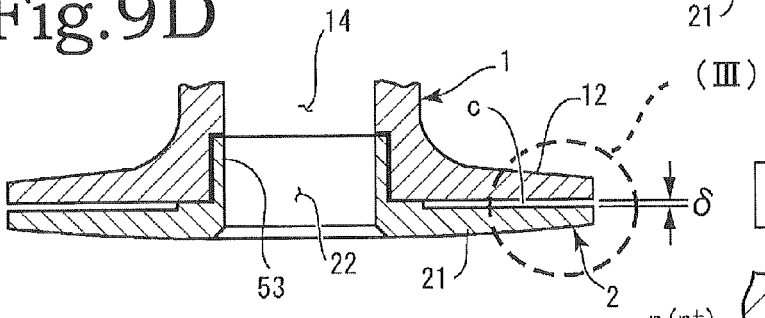
FIG. 9D is a main part longitudinal sectional side view of a second embodiment of the present invention.

As a third type of the first embodiment, the protrusion sections 31 are formed in both of the outer flange 2 and the second flange 12 (see FIG. 9D). In the third type, the same number of the protrusion sections 31 are formed in each of the outer flange 2 and the second flange 12.

On the housing side surfaces 12*a* and 21*a* of the outer flange 2 and the second flange 12, the protrusion sections 31 are arranged at an equal interval on circumferences having the same diameter. The protrusion sections 31 of the outer flange 2 and the second flange 12 are arranged and formed to be in the same position such that the distal ends of the protrusion sections 31 are in contact with each other.

In the third type, the protrusion sections 31 formed in the outer flange 2 and the second flange 12 have regularity as explained above. However, the protrusion sections 31 do not always need to be configured in this way. Forming positions of the protrusion sections 31 may be determined as appropriate.

In a second embodiment of the thread come-off preventing unit 3, the space dimension δ of the gap c is set to be equal to or smaller than the thread diameter d of the bobbin thread n wound around the bobbin winder spindle 13 of the bobbin of the present invention (see FIGS. 9D and 9D).

That is, δ≤d. The thread diameter d means that a diameter dimension of the thread is d.

To house the bobbin thread n in the gap c without deforming the bobbin thread n, it is preferable to set the space dimension δ of the gap c to be slightly smaller than the thread diameter d of the bobbin thread n. Specifically, it is preferable that, in a state in which the thread end nt of the bobbin thread n is inserted into the gap c, the thread n receives a light holding pressure from the housing side surfaces 12*a* and 21*a* and stays on the inside of the gap c while being held by the housing side surfaces 12*a* and 21*a*.

Figure 9E:
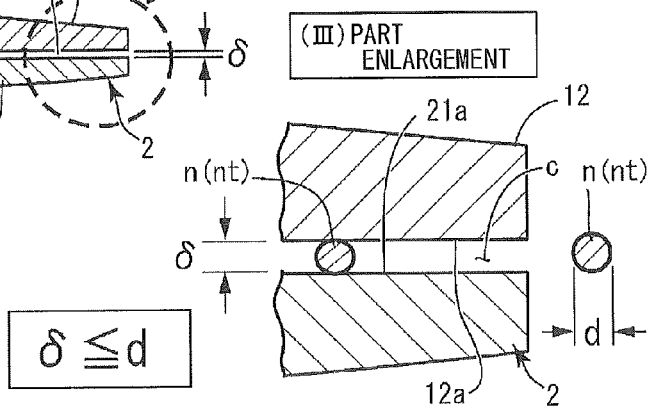
FIG. 9E is a (III) part enlarged view of FIG. 9D.

The thread end nt of the bobbin thread n can be housed in a stable state by inserting the bobbin thread n into the gap c formed by the housing side surfaces 12*a* and 21*a* and housing the bobbin thread n (see FIGS. 9D and 9E). That is, the thread come-off preventing unit 3 in the second embodiment applies a slight pressure from the gap c to the thread end nt to keep the thread end nt in the gap c (see FIG. 9E).

The gap forming unit 4 forms the gap c between the outer flange 2 and the second flange 12 and sets the space dimension δ of the gap c (see FIGS. 1B and 1D). A first type of the gap forming unit 4 is a stepped swelling section 41.

The stepped swelling section 41 is a section formed in an annular shape and a step shape in a circumferential edge part of the through-hole 22 in the diameter center of any one of the outer flange 2 and the second flange 12 along the circumference of the through-hole 22 (see FIGS. 1B, 2C, 3, 9D, and the like). In the following explanation, the stepped swelling section 41 is formed on the outer flange 2 side.

A height dimension of the stepped swelling section 41 is the same as the space dimension δ of the gap c with respect to the housing side surface 21*a* (see FIG. 1B). The gap c having the space dimension δ is formed between the housing side surfaces 12*a* and 21*a* of the second flange 12 and the outer flange 2 by the stepped swelling section 41.

Figure 2E:
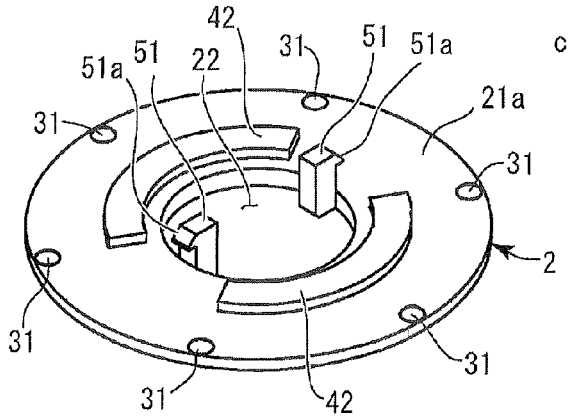
FIG. 2E is a perspective view of the outer flange including a gap forming unit of a second type.

As a modification of the stepped swelling section 41, two or more partial swelling sections 42 are formed to be point symmetrical with respect to the diameter center position of the housing side surface 21*a* (see FIG. 2E). The top surface of the partial swelling section 42 is a flat surface. Specifically, the partial swelling section 42 is a swelling section having a substantially semicircular shape. A height dimension of the partial swelling section 42 is δ.

Further, as a second type of the gap forming unit 4, the protrusion section 31 is used as the thread come-off preventing unit 3 and is also used as the gap forming unit 4 (see FIG. 9C). That is, the height of the protrusion section 31 is set to the space dimension δ of the gap c.

In the present invention, the thread come-off preventing unit 3 formed as the protrusion section 31 and the gap forming unit 4 are often used together. However, when the protrusion section 31 is used as the gap forming unit 4, the gap forming unit 4 (the stepped swelling section 41 and the partial swelling section 42) is sometimes not provided (see FIG. 9C).

Further, in the present invention, when the embodiment is used, the protrusion section 31 is absent in the second flange and the outer flange 2. Only the gap forming unit 4 forming the gap c is provided in the bobbin (see FIG. 9D).

The second flange 12 of the bobbin main body 1 and the outer flange 2 are joined by the joining section 5 to be capable of separating from each other. As a first type of the joining section 5, there is the joining section 5 in which a fitting protrusion 51 is formed on the outer flange 2 side and a section to be fit 52, which fits with the fitting protrusion 51, is formed on the second flange 12 side.

Specifically, a pair of the fitting protrusions 51 including hook-like fitting projecting pieces 51*a* is formed on the housing side surface 21*a* side of the outer flange 2 and in both end parts in the diameter direction at the circumferential edge of the through-hole 22 (see FIG. 2B). On the second flange 12 side of the bobbin main body 1, a pair of the sections to be fit 52, in which the fitting protrusions 51 fit, is formed.

The sections to be fit 52 are formed in an insertion cylindrical section 15 formed at the circumferential edge of the through-hole 14 of the second flange 12 and projecting in the axial direction (see FIG. 2B). To join the bobbin main body 1 and the outer flange 2, the insertion cylindrical section 15 of the second flange 12 is inserted into the through-hole 22 of the outer flange 2 and the fitting protrusions 51 of the outer flange 2 are fit in the sections to be fit 52 on the bobbin main body 1 side to fit and fix the bobbin main body 1 and the outer flange 2 (see FIG. 3).

As a second type of the joining section 5, a cylindrical collar section 53 projecting in the axial direction is formed on the outer flange 2 side. The collar section 53 is press-fit in and fixed to the through-hole 14 in the diameter center of the second flange 12 to join and fix the second flange 12 (see FIG. 9D).

A process for housing the thread end nt of the bobbin thread n wound around the bobbin in the gap c in the present invention is explained with reference to FIGS. 4 to 8. In the explanation, the protrusion section 31 is used as the thread come-off preventing unit 3.

First, the thread end nt of the bobbin thread n is drawn out from the bobbin by an appropriate amount (FIGS. 4A and 4B). Subsequently, while the bobbin thread n is pressed against the second flange 12 and the outer circumferential edge of the outer flange 2 by a finger tip, the thread end nt of the bobbin thread n is inserted to be pushed into the gap c (see FIGS. 4C, 4D, 6, and the like). Subsequently, the thread end nt of the bobbin thread n inserted into the gap c is slightly strongly pulled and fed to the inner side of the gap c to climb over the protrusion section 31. (see FIGS. 4E, 4F, 7, and the like).

The thread end nt of the bobbin thread n inserted into the gap c is further pulled and arranged on the inner side of the gap c to climb over the two or more protrusion sections 31. Consequently, the thread end nt entering the inner side of the gap c is confined in the gap c by the plurality of protrusion sections 31. The thread end nt can be prevented from projecting to the outside of the gap c by the protrusion sections 31.

In a second embodiment of the present invention (see FIGS. 9D and 9E), in a state in which the thread end nt of the bobbin thread n is inserted into the gap c, the thread end nt is fixed to the housing side surfaces 12*a* and 21*a* in a held state. It is possible to house the thread end nt of the bobbin thread n in a stable state (see FIG. 9E).

In the second embodiment, in the gap the thread come-off preventing unit that prevents the housed thread end of the bobbin thread from coming off the gap is provided. Therefore, it is possible to prevent the thread end of the bobbin thread inserted into the gap from coming off the gap. The gap is provided between the outer flange and the second flange. Therefore, it is possible to easily form the gap and simplify the structure of the bobbin.

In a third embodiment, it is possible to extremely simply configure the thread come-off preventing unit only by forming the protrusion section in at least one of the outer flange and the flange of the bobbin main body. When the thread end of the bobbin thread is retained by the gap, it is possible to house the thread end in the inner part of the gap using the protrusion simply by inserting the thread end into the gap and housing the thread end in the inner side of the gap to climb over the protrusion section. Further, the bobbin thread housed in the gap is stopped by the protrusion section. Therefore, it is possible to prevent the thread end from coming off the gap and stably retain the thread end.

In a fourth embodiment, the protrusion section is formed on the outer flange side. Therefore, the shape on the bobbin main body side, where the protrusion section is not formed, is simplified. It is possible to suppress manufacturing cost. In particular, if the outer flange is formed of soft synthetic resin, the entire outer flange is easily deformed. When the bobbin thread is inserted into the gap, the bobbin thread can naturally and smoothly climb over the protrusion.

In a fifth embodiment, the protrusion section is formed in the flange of the bobbin main body. Therefore, the shape of the outer flange, in which the protrusion section is not formed, can be simplified. Other effects are the same as the effects of the fourth embodiment. In a sixth embodiment, the protrusion sections are formed in both of the outer flange and the second flange. Therefore, the protrusion sections can be configured to project toward both of the outer flange and the second flange. Consequently, it is possible to more surely retain the thread end housed in the gap.

In a seventh embodiment, in the bobbin, a gap having a diameter equal to or larger than the thread diameter of the bobbin thread is provided between the flange of the bobbin main body and the outer flange. When the thread end of the bobbin thread drawn out from the bobbin is inserted into the gap, since the space dimension of the gap is set equal to or smaller than the thread diameter, the bobbin thread can be generally held by the housing side surfaces of the flange and the outer flange and stably housed when housed in the gap.

In particular, by setting the gap to be slightly smaller than the thread diameter of the bobbin thread, the bobbin thread appropriately receives weak pressure in the gap. The bobbin thread can be naturally inserted into the gap. The bobbin thread is fixed in a state in which the bobbin thread is inserted into the gap. Consequently, the bobbin thread can be more stably housed without being deformed.

What is claimed is:

1. A bobbin in which a needle attached to a needle bar, which moves up and down, and a horizontal shuttle supply in cooperation with each other a bobbin thread for forming a stitch, the bobbin comprising:

a bobbin main body including flanges at both ends of a bobbin winder spindle for winding the bobbin thread; and an outer flange attached to one of the flanges of the bobbin main body, wherein a gap in which a thread end of the bobbin thread is housed is provided between the outer flange and the flange of the bobbin main body, and wherein a thread come-off preventing unit that prevents the housed thread end of the bobbin thread from coming off the gap is provided in the gap.

2. A bobbin in which a needle attached to a needle bar, which moves up and down, and a horizontal shuttle supply in cooperation with each other a bobbin thread for forming a stitch, the bobbin comprising:

a bobbin main body including flanges at both ends of a bobbin winder spindle for winding the bobbin thread; and an outer flange attached to one of the flanges of the bobbin main body, wherein a gap in which a thread end of the bobbin thread is housed is provided between the outer flange and the flange of the bobbin main body, wherein a thread come-off preventing unit that prevents the housed thread end of the bobbin thread from coming off the gap is provided in the gap, and wherein the thread come-off preventing unit is formed as a protrusion section that projects from at least one of the outer flange and the flange of the bobbin main body to face the other one of the outer flange and the flange of the bobbin main body.

3. The bobbin according to claim 2, wherein the protrusion section is formed in the outer flange.

4. The bobbin according to claim 2, wherein the protrusion section is formed in the flange of the bobbin main body.

5. The bobbin according to claim 2, wherein protrusion sections are formed in the flange of the bobbin main body and the outer flange respectively.

* * * * *